US008383205B2

(12) United States Patent
Rosing et al.

(10) Patent No.: US 8,383,205 B2
(45) Date of Patent: Feb. 26, 2013

(54) METHODS FOR TREATING TEXTILES WITH AN ANTIMICROBIAL COMPOSITION

(75) Inventors: Howard S. Rosing, Naples, FL (US); Yu-Te Lin, Taipei (TW); Chieh-Fu Huang, Dongguan (CN); Ronald I. Pass, Naples, FL (US)

(73) Assignee: BioMed Protect, LLC, St. Louis, MO (US)

( * ) Notice: Subject to any disclaimer, the term of this patent is extended or adjusted under 35 U.S.C. 154(b) by 229 days.

(21) Appl. No.: 12/797,671

(22) Filed: Jun. 10, 2010

(65) Prior Publication Data

US 2011/0305844 A1 Dec. 15, 2011

(51) Int. Cl.
*B05D 3/02* (2006.01)

(52) U.S. Cl. ..... 427/394; 427/240; 427/359; 427/365; 427/369; 427/384; 427/396; 427/430.1; 427/439

(58) Field of Classification Search ..... None
See application file for complete search history.

(56) References Cited

U.S. PATENT DOCUMENTS 5,882,357 A 3/1999 Sun
6,444,214 B1 * 9/2002 Cole et al. ..... 424/401
2003/0088923 A1 5/2003 Sivik
2005/0227902 A1 * 10/2005 Erazo-Majewicz et al. .. 510/470
2007/0077428 A1 4/2007 Hamed
2007/0258996 A1 11/2007 Mookerjee
2008/0102217 A1 5/2008 Lin
2008/0194518 A1 8/2008 Mookerjee
2009/0156563 A1 * 6/2009 Baschong et al. ..... 514/159
2009/0306154 A1 * 12/2009 Pillai et al. ..... 514/361
2011/0052651 A1 3/2011 Rosing

OTHER PUBLICATIONS

International Search Report and Written Opinion dated Jul. 22, 2011.
Montazer, M. et al., "Simultaneous X-Linking and antimicrobial finishing of cotton fabric", Journal of Applied Polymer Science, 2007, vol. 103, pp. 178-185. See p. 179; Experimental (fabric treatment); tablet I-IV.
International Search Report and Written Opinion, mailing date of Sep. 14, 2010.

* cited by examiner

*Primary Examiner* — Erma Cameron
(74) *Attorney, Agent, or Firm* — Thomas Horstemeyer

(57) ABSTRACT

In one embodiment, a method for treating a textile with an antimicrobial composition includes preparing an antimicrobial composition that includes water, an organic acid, chitosan, and one or more heterocyclic N-halamine compounds, preparing an aqueous solution that comprises the antimicrobial composition, applying the aqueous solution to a textile, and heating the textile to cure the antimicrobial composition.

30 Claims, 1 Drawing Sheet

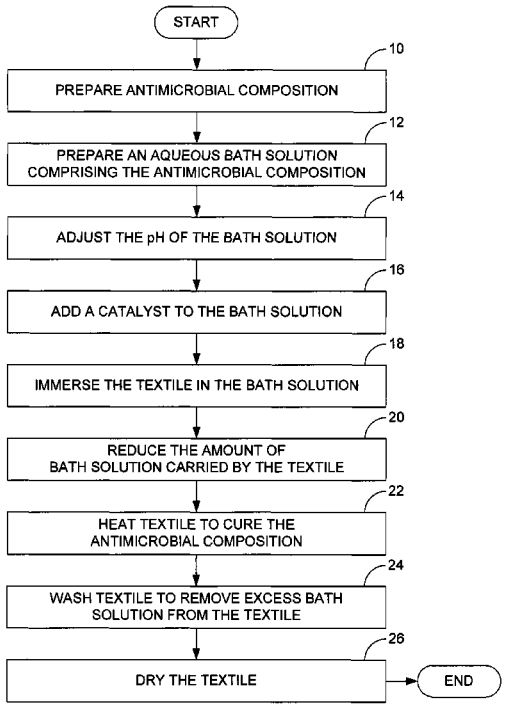

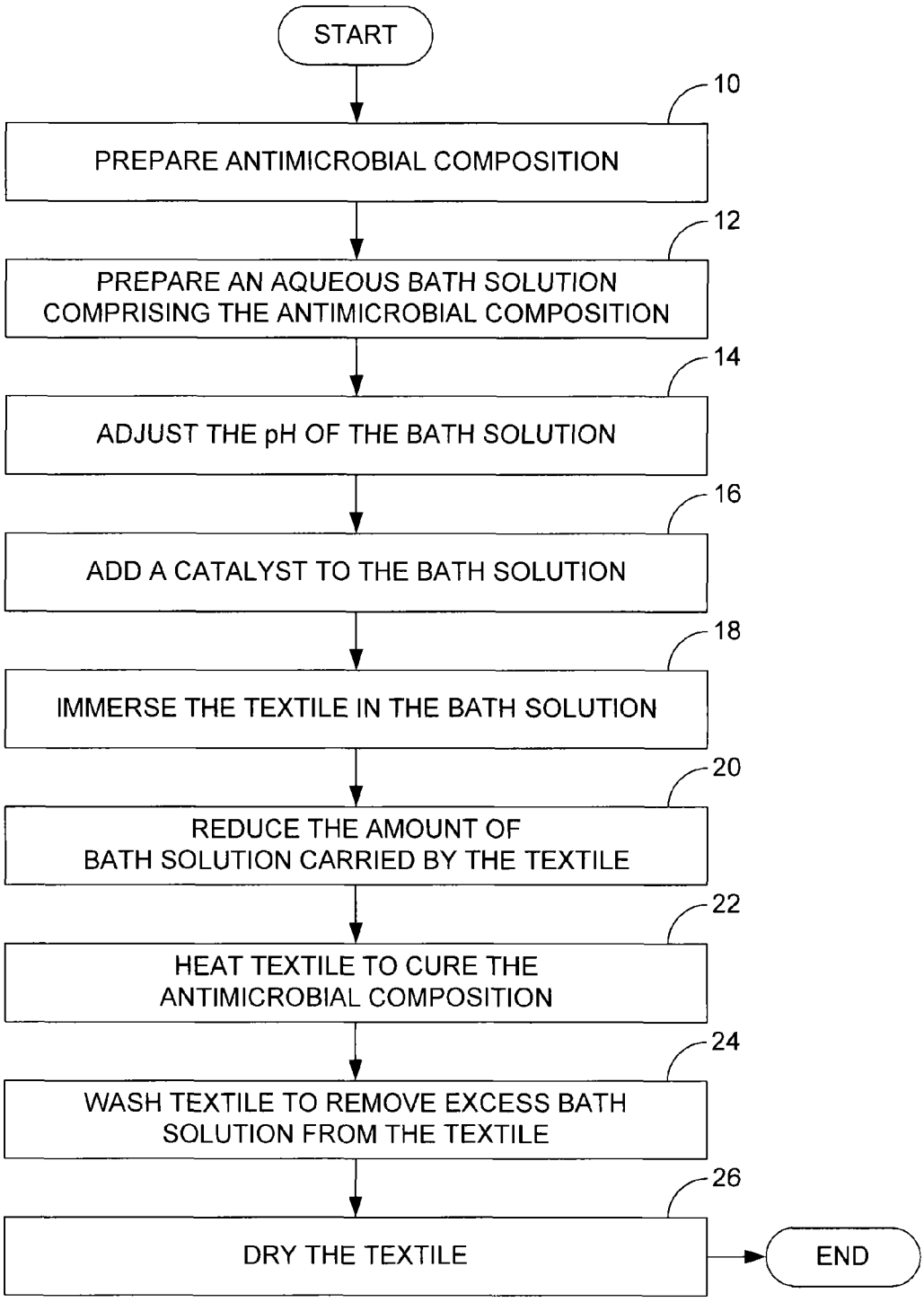
START
10
PREPARE ANTIMICROBIAL COMPOSITION
12
PREPARE AN AQUEOUS BATH SOLUTION COMPRISING THE ANTIMICROBIAL COMPOSITION
14
ADJUST THE pH OF THE BATH SOLUTION
16
ADD A CATALYST TO THE BATH SOLUTION
18
IMMERSE THE TEXTILE IN THE BATH SOLUTION
20
REDUCE THE AMOUNT OF BATH SOLUTION CARRIED BY THE TEXTILE
22
HEAT TEXTILE TO CURE THE ANTIMICROBIAL COMPOSITION
24
WASH TEXTILE TO REMOVE EXCESS BATH SOLUTION FROM THE TEXTILE
26
DRY THE TEXTILE
END

METHODS FOR TREATING TEXTILES WITH AN ANTIMICROBIAL COMPOSITION

BACKGROUND

There are many reasons for wanting to incorporate antimicrobial agents into textiles. For instance, antimicrobial activity may enhance the durability of textiles by inhibiting the growth of bacteria and fungi that live in textiles and cause damage to their components. Textiles with antimicrobial activity also prevent the creation of odors by preventing or reducing microbes from feeding on the organic materials in the textile. Additionally, antimicrobial treated textiles may kill pathogenic microbes thereby protecting the wearer from exposure to disease agents.

Other uses of antimicrobial treated textiles include wound care. For example, a medical bandage that has been treated with antimicrobial agents offers the wound a favorable environment for healing and further prevents bacterial organisms from growing at the site. Furthermore, antimicrobial treated textiles may prevent disease-causing microorganisms from surviving or even proliferating on the surface or in the internal crevices of the textile when the cloth soaks up or is exposed to contaminated fluid. The use of antimicrobial cloths may also prevent the cross contamination of bacterial infections between people or patients in a close environment, such as in a hospital, prison or on a military base.

Antimicrobial bedding linens offer an enhanced level of hygiene and security in hospital or hotel rooms. Their use may limit the transfer of bacterial disease in hospitals and lower the rates at which hospitalized patients acquire nosocomial infections, which have been increasing in frequency in recent years.

While textiles possessing antimicrobial characteristics have been introduced in recent years, most of these textiles are prepared by adding antimicrobial agents to the textile. Specifically, antimicrobial agents are impregnated into or coated onto the fibers of the textile during the manufacturing process. The antimicrobial agents are not, however, permanently bound to the textile fibers and are thus prone to leaching, such that these agents are absorbed by human skin. In addition to leaching, the antimicrobial agents are not able to withstand numerous washings, so that the antimicrobial effect may not last long. While certain treated textiles are known to be regenerable after exhaustion by the treated textiles, use of chlorine bleach is necessary to regenerate antimicrobial activity.

Thus, there is a need to overcome the aforementioned disadvantages. Current antimicrobial treatment of textile leaves a need for a means of providing various textiles with minimal leaching, more permanent antimicrobial characteristics, and that does not require use of chlorine bleach for regenerable antimicrobial properties.

BRIEF DESCRIPTION OF THE DRAWINGS

FIG. 1 is a flow diagram of a method for treating a textile with an antimicrobial composition.

DETAILED DESCRIPTION

Although particular embodiments are described herein, those embodiments comprise mere examples of the disclosed inventions and are not intended to limit this disclosure. Terminology used herein serves the purpose of describing those embodiments, and is not intended to be limiting, since the scope of the present disclosure will be limited only by the appended claims.

Where a range of values is provided, each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Ratios, concentrations, amounts, and other numerical data can be expressed herein in a range format. Such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. For illustration purposes only, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. The term "about" or "approximately" can include an acceptable error for a particular value as determined by one of ordinary skill in the art of general chemistry, organic chemistry, polymer chemistry, materials science, which depends in part on how the value is measured or determined. In certain embodiments, "about" can mean one or more standard deviations.

As will be apparent to those of skill in the art upon reading this disclosure, each of the individual embodiments described and illustrated herein has discrete components and features which can be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of general chemistry, organic chemistry, polymer chemistry, materials science, and the like, which are within the skill of the art. Such techniques are explained fully in the literature.

Prior to describing the various embodiments, the following definitions are provided and should be used unless otherwise indicated.

I. Definitions

Unless otherwise defined, all technical and scientific terms used herein have the same meaning as commonly understood by one of ordinary skill in the art of general chemistry, organic chemistry, polymer chemistry, and materials science. Although methods and materials similar or equivalent to those described herein can be used in the practice or testing of the present disclosure, suitable methods and materials are described herein.

As used in the specification and the appended claims, the singular forms "a," "an," and "the" may include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

As used herein, "DMDMH", or "DMDM hydantoin" refers to 1,3-dimethylol-5,5-dimethylhydantoin,

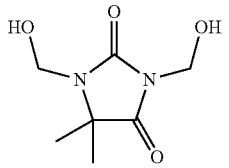

[i.e., 1,3-bis(hydroxymethyl)-5,5-dimethylhydantoin], which has the CAS Number 6440-58-0.

As used herein, "MDMH" or "MDM hydantoin" refers to 1-methylol-5,5-dimethylhydantoin,

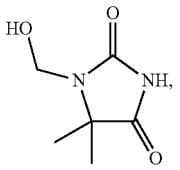

[i.e., 1-(hydroxymethyl)-5,5-dimethylhydantoin] which has the CAS number 116-25-6.

As used herein, "chitosan" refers to

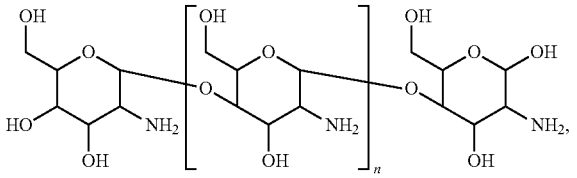

wherein n is about 3 to about 6000.

As used herein, "textile" refers to a material containing natural and/or artificial fibers. In some cases, the textile comprises about 5% to about 100% cellulose. The antimicrobial compositions of the present disclosure may be applied during or after processing to textiles such as clothing, including uniforms, socks, undergarments; medical textiles, including patent drapes, gauzes, surgeon's gowns, caps, masks, and hospital bedding and curtains; and household textiles, including carpet, bedding, and drapes.

As used herein, "antimicrobial" or "antimicrobial composition" refers to a substance capable of killing or inhibiting the growth of microorganisms, such as bacteria (e.g., *Streptococcus, Enterococcus*, Bacteroidaceae, Enterobacteriaceae, Vibrionaceae, Pasteurellae, *Acinetobacter*, Pseudomonadaceae, *Escherichia coli, Staphylococcus aureus, Shigalla sonnei, Salmonella enteritidis, Salmonella choterse-suis, Pseudomonas aeruginosa*, VRE, MRSA, *Proteus mirabilis, Campylobacter jejuni*, and *Brevibacterium*), viruses (e.g., MS-2 Bacteriophage, *Candida albicans*, influenza strain A, influenza strain B, and Swine Influenza), fungi (e.g., *Malassezia furfur* and *Trichophyton mentagrophytes*), and protozoans.

II. Embodiments of the Present Disclosure

Embodiments of the present disclosure include antimicrobial compositions, methods of preparing these antimicrobial compositions, textiles including antimicrobial compositions, and methods for treating a textile with an antimicrobial composition. Accordingly, embodiments of the present disclosure include textiles treated with the antimicrobial compositions described below and methods of applying these antimicrobial compositions to textiles. Examples of textiles which may be treated with the antimicrobial compositions described below include medical textiles, housing textiles, and textiles related to garments.

Embodiments of the antimicrobial compositions of the present disclosure may be added to a variety of textiles. Textiles that have been treated with the antimicrobial compositions or treated antimicrobial compositions of the present disclosure demonstrate antimicrobial activity. Moreover, the antimicrobial effect demonstrated by these treated textiles is highly durable, such that these textiles may be washed numerous times with little to no loss of antimicrobial activity. In certain embodiments, the antimicrobial aspect of the textile is renewable or regenerable without the addition of chlorine bleach. Additionally, textiles treated with the antimicrobial compositions of the present disclosure demonstrate negligible leaching and are thus unlikely to pose health concerns to those coming into contact with these treated textiles.

An embodiment of the present disclosure includes antimicrobial compositions in the form of an aqueous solution consisting of water, an organic acid present in about 0.1% to about 10% by weight of solution, chitosan present in about 0.1% to about 10% by weight of solution, as well as one or more heterocyclic N-halamine compounds present in about 5% to about 90% by weight of solution. Examples of organic acids suitable for use in the antimicrobial compositions of the present disclosure include, but are not limited to, citric acid, acetic acid, lactic acid, formic acid, and oxalic acid. Examples of heterocyclic N-halamine compounds suitable for use in the antimicrobial compositions of the present disclosure include, but are not limited to MDMH, DMDMH; monomethylolated and dimethylolated derivatives of 2,2,5,5-tetramethyl-1,3-imidazolidin-4-one, 6,6-dimethyl-1,3,5-triazine-2,4-dione, 4,4,5,5-tetramethyl-1,3-imidazolidin-2-one, cyanuric acid, and 5,5-dimethylhydantoin; and monomethoxylated and dimethoxylated derivatives of monomethylolated and dimethylolated derivatives of 2,2,5,5-tetramethyl-1,3-imidazolidin-4-one, 6,6-dimethyl-1,3,5-triazine-2,4-dione, 4,4,5,5-tetramethyl-1,3-imidazolidin-2-one, cyanuric acid, 5,5-dimethylhydantoin. Examples of the monomethoxylated and dimethoxylated compounds are monomethoxymethyl-5,5-dimethylhydantoin and 1,3-dimethoxymethyl-5,5-dimethylhydantoin, respectively.

One embodiment of the present disclosure includes an aqueous solution consisting of water, citric acid, chitosan, and DMDMH, e.g., an aqueous solution consisting of water, about 0.2% to about 1.0% of citric acid by weight of solution, about 0.2% to about 1.0% chitosan by weight of solution, and about 30% to about 35% DMDMH by weight of solution.

One embodiment of the present disclosure includes an aqueous solution consisting of water, citric acid, chitosan, and MDMH, e.g., an aqueous solution consisting of water, about 0.2% to about 1.0% of citric acid by weight of solution, about 0.2% to about 1.0% chitosan by weight of solution, and about 30% to about 35% MDMH by weight of solution.

One embodiment of the present disclosure includes an aqueous solution consisting of water, citric acid, chitosan, DMDMH, and MDMH, e.g., an aqueous solution consisting of water, about 0.2% to about 1.0% of citric acid by weight of solution, about 0.2% to about 1.0% chitosan by weight of solution, about 20% to about 25% DMDMH by weight of solution, and about 20% to about 25% MDMH by weight of solution.

In addition to the aforementioned embodiments, embodiments of the present disclosure may also include compositions comprising the antimicrobial compositions of the present disclosure. For example, embodiments of the present disclosure may include each of the ingredients of the antimicrobial compositions as described and further include other compounds, such as additives used to ready the antimicrobial composition of the present disclosure for application to textiles. Examples of additives that may be used in conjunction with the antimicrobial compositions of the present disclosure include, but are not limited to, an ionic halide salt, an organic acid, and water. Examples of ionic halide salts suitable for use as treatment solutions for use in conjunction with the antimicrobial compositions of the present disclosure include, but are not limited to, magnesium chloride, magnesium bromide, calcium chloride, calcium bromide, potassium chloride, and combinations thereof.

One embodiment of the present disclosure includes an aqueous solution comprising water, an organic acid present in about 0.1% to about 10% by weight of solution, chitosan present in about 0.1% to about 10% by weight of solution, and one or more N-halamine compounds (e.g. MDMH and/or DMDMH) present in about 5% to about 90% by weight of solution. The solution can be diluted with water, pH adjusted to about 1.0 to about 5.0 using an organic acid (e.g., citric acid, acetic acid, and/or lactic acid), and can further comprise an ionic halide salt (e.g., magnesium chloride, magnesium bromide, and/or calcium chloride) present in about 1% to about 10% by weight of solution.

One embodiment of the present disclosure includes an aqueous solution comprising water, citric acid, chitosan, and DMDMH, e.g., an aqueous solution of water, about 0.2% to about 1.0% of citric acid by weight of solution, about 0.2% to about 1.0% chitosan by weight of solution, and about 30% to about 35% DMDMH by weight of solution. The solution can be diluted with water, pH adjusted to about 3.0 to about 3.5 using citric acid, and can further comprise magnesium chloride present in about 4.0% to about 7.0% by weight of solution.

One embodiment of the present disclosure includes an aqueous solution comprising water, citric acid, chitosan, and MDMH, e.g., an aqueous solution consisting of water, about 0.2% to about 1.0% of citric acid by weight of solution, about 0.2% to about 1.0% chitosan by weight of solution, and about 30% to about 35% MDMH by weight of solution. The solution can be diluted with water, pH adjusted to about 2.5 to about 5.0 using citric acid, and can further comprise magnesium chloride present in about 2.0% to about 7.0% by weight of solution.

One embodiment of the present disclosure includes an aqueous solution comprising water, citric acid, chitosan, DMDMH, and MDMH, e.g., an aqueous solution consisting of water, about 0.2% to about 1.0% of citric acid by weight of solution, about 0.2% to about 1.0% chitosan by weight of solution, about 20% to about 25% DMDMH by weight of solution, and about 20% to about 25% MDMH by weight of solution. The solution can be diluted with water, pH adjusted to about 3.0 to about 3.5 using citric acid, and can further comprise magnesium chloride present in about 2.0% to about 7.0% by weight of solution.

One embodiment of the present disclosure includes a method of treating textiles with the antimicrobial compositions of the present disclosure. The textiles can be treated by either applying the antimicrobial composition to the textile, or immersing the textile in the antimicrobial composition. For example, textiles may be sprayed with the antimicrobial compositions of the present disclosure. Alternatively, textiles may be dipped into baths of the antimicrobial compositions of the present disclosure. Regardless, treatment results in a textile composing an antimicrobial composition. Addition of the antimicrobial compositions of the present disclosure to such textiles results in the heterocyclic N-halamine compound covalently bonding to the cellulose:

FIG. 1 illustrates an example embodiment of a method for treating a textile with an antimicrobial composition. In some embodiments, the antimicrobial composition comprises a composition that includes water, an organic acid, chitosan, and one or more heterocyclic N-halamine compounds. Although the various actions of the example method are described in a particular order, it is noted that several of the actions identified in FIG. 1 and described below can be performed in an alternative order without effecting the final result.

Beginning with block 10, an aqueous antimicrobial solution is prepared. Once the antimicrobial composition has been prepared, an aqueous bath solution that comprises the antimicrobial solution and water can be prepared, as indicated in block 12. The volume of the bath solution and the amount of aqueous antimicrobial solution that is used depends upon the textile. For example, approximately 468 kilograms (kg) of water and approximately 31 kg of aqueous antimicrobial solution can be used to treat a 100% cotton textile weighing 500 kg. For a 65% cotton fabric of the same weight, approximately 471 kg of water and approximately 29 kg of aqueous antimicrobial solution can be used. For a 35% cotton fabric of the same weight, approximately 473 kg of water and approximately 27 kg of aqueous antimicrobial solution can be used. In some embodiments the concentration of the aqueous antimicrobial solution is more diluted with water as the percentage of cellulosic material in the textile is reduced.

Next, with reference to block 14, the pH of the bath solution can be adjusted, if necessary. In some embodiments, the pH is adjusted to be less than 3.5 by adding citric acid as needed.

Referring next to block 16, a catalyst is added to the bath solution. In some embodiments, magnesium chloride is used as the catalyst. By way of example, 250 grams of magnesium chloride can be added for every approximately 40 kg of bath solution.

At this point, the textile can be immersed in the bath solution, as indicated in block 18, to apply the antimicrobial composition to the textile. In some embodiments, the textile is immersed in a tank that holds the bath solution using a continuous feed process. As indicated in block 20, the amount of bath solution carried by the textile can then be reduced. In some embodiments, the textile is run through squeeze rollers or placed in a centrifugal separator so that excessive bath solution is extracted from the exposed wet textile. In some embodiments that extracted bath solution is 50% to 95% of the original bath solution that is initially absorbed by the wet textile.

The textile is next heated to cure the antimicrobial composition in place on the textile, as indicated in block 22. In some embodiments, the textile is heated at a temperature of approximately 90° C. to 195° C. for at least 15 seconds. For example, the textile can be heated for approximately 15 to 180 seconds. In other embodiments, the textile is heated at a temperature of approximately 150° C. to 170° C. for approximately 30 to 60 seconds. By way of example, the textile can be heated in an oven or other heating unit. In some embodiments, the curing temperature is set based on the percentage of cellulosic material (e.g., cotton) in the textile. For textiles that are 100% cotton, an example curing temperature may be 150° C. in a tumbler dryer. For textiles that are 35% cotton, an example curing temperature may be 175° C. in the tumbler dryer. Furthermore, the antimicrobial effect may last longer (e.g., more than two years) if the curing temperature is higher, for example over 150° C.

In some embodiments, textiles are treated during their manufacturing process. In other embodiments, finished textiles that are already in commercial use are treated during a normal wash cycle. The antimicrobial effect is substantially the same whether the treatment occurs during the manufacturing process or during a wash cycle.

After curing, the textile can be washed (block 24) in warm or cold water to remove any excess bath solution from the textile and dried (block 26), for example at a typical dryer temperature of 95° C.

The antimicrobial effect will eventually dissipate with repeated washing of the textile. In some embodiments, the durability of the treatment depends upon the amount of cellulosic material the textile comprises. For example, textiles with a smaller percentage of cellulosic material (e.g. 15% cotton or less by weight) may lose the antimicrobial effect after only 100 washings, while textiles made of 100% cellulosic material (e.g., 100% cotton) may not lose the antimicrobial effect for over 200 washings. Whichever the case, the antimicrobial effect can be reinstated using the treatment process described above.

Irrespective of the manner in which antimicrobial activity is imparted to the textile, the addition of the antimicrobial compositions results in the heterocylic N-halamine compound and/or the chitosan covalently bonding to the cellulose:

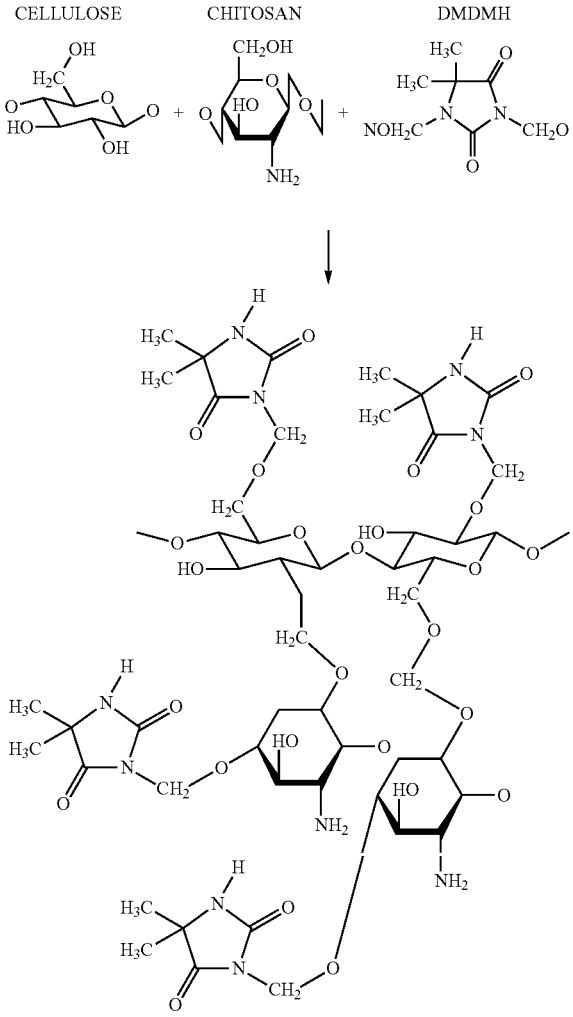

EXAMPLES

The following synthetic and biological examples are offered to illustrate embodiments of the present disclosure, and are not to be construed in any way as limiting the scope of the disclosure. In the examples below, abbreviations have their generally accepted meanings.

Example 1

10 g of chitosan,

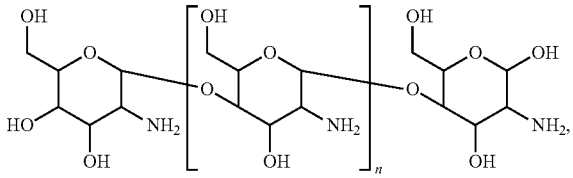

and 10 g of citric acid,

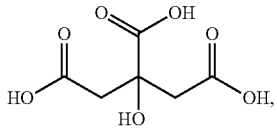

are dissolved in 980 g of $H_2O$. The resulting solution is combined with 1500 g of a solution containing 55% of DMDMH,

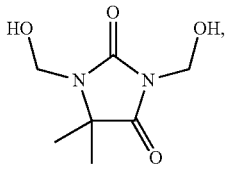

by weight of solution to produce approximately 2500 g of an antimicrobial composition which is approximately:

0.4% citric acid by weight of solution,
0.4% chitosan by weight of solution,
33% DMDMH by weight of solution, and
66.2% $H_2O$ by weight of solution.

Example 2

10 g of chitosan,

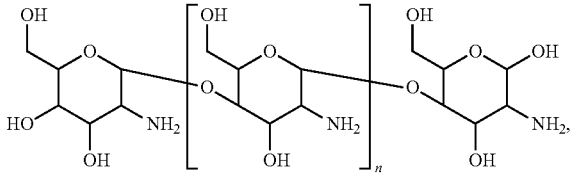

and 10 g of citric acid,

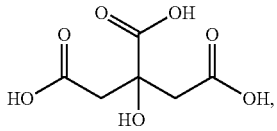

are dissolved in 980 g of $H_2O$. The resulting solution is combined with 1500 g of a solution containing 55% of MDMH,

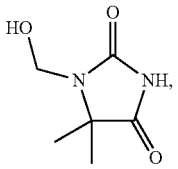

by weight of solution to produce approximately 2500 g of an antimicrobial composition which is approximately:

0.4% citric acid by weight of solution,
0.4% chitosan by weight of solution,
33% MDMH by weight of solution, and
66.2% $H_2O$ by weight of solution.

Example 3

10 g of chitosan,

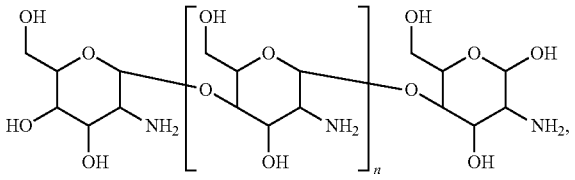

and 10 g of citric acid,

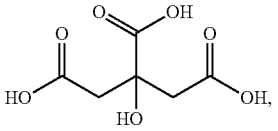

are dissolved in 780 g of $H_2O$. The resulting solution is combined with 1700 g of a solution containing 33.2% by weight DMDMH,

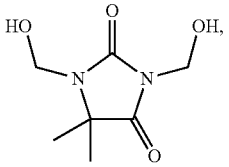

and 31.5% MDMH,

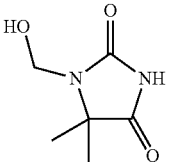

to produce an antimicrobial composition which is approximately:

0.4% citric acid by weight of solution,
0.4% chitosan by weight of solution,
22.6% DMDMH by weight of solution, and
21.4% MDMH by weight of solution.
55.2% $H_2O$ by weight of solution.

Example 4

The composition of Example 1, made up of citric acid, chitosan, DMDMH, and water, may be put into a form convenient for textile treatment. Approximately 2500 g of an antimicrobial composition which is approximately:

0.4% citric acid by weight of solution,
0.4% chitosan by weight of solution,
33% DMDMH by weight of solution, and
66.2% $H_2O$ by weight of solution is diluted by 39.16 kg $H_2O$ forming a 41.66 kg dilute antimicrobial composition. pH of the resulting dilute antimicrobial composition is kept in the range of about 3.0 to about 3.5 using citric acid. Finally, 250 g of magnesium chloride is added to the solution to produce a treated antimicrobial composition for use in textile treatment.

Example 5

The composition of Example 2, made up of citric acid, chitosan, MDMH, and water, may be put into a form convenient for textile treatment. Approximately 2500 g of an antimicrobial composition which is:

0.4% citric acid by weight of solution,
0.4% chitosan by weight of solution,
33% MDMH by weight of solution, and
66.2% $H_2O$ by weight of solution is diluted by 39.16 kg $H_2O$ forming a 41.66 kg dilute antimicrobial composition. pH of the resulting dilute antimicrobial composition is kept in the range of about 3.0 to about 3.5 using citric acid. Finally, 250 g of magnesium chloride is added to the solution to produce a treated antimicrobial composition for use in textile treatment.

Example 6

The composition of Example 3, made up of citric acid, chitosan, DMDMH, MDMH, and water, may be put into a form convenient for textile treatment. Approximately 2500 g of an antimicrobial composition which is:

0.4% citric acid by weight of solution,
0.4% chitosan by weight of solution,
22.6% DMDMH by weight of solution, and
21.4% MDMH by weight of solution.
55.2% $H_2O$ by weight of solution is diluted by 39.16 kg $H_2O$ forming a 41.66 kg dilute antimicrobial composition. pH of the resulting dilute antimicrobial composition is kept in the range of about 3.0 to about 3.5 using citric acid. Finally, 250 g of magnesium chloride is added to the solution to produce a treated antimicrobial composition for use in textile treatment.

Example 7

10 g of chitosan,

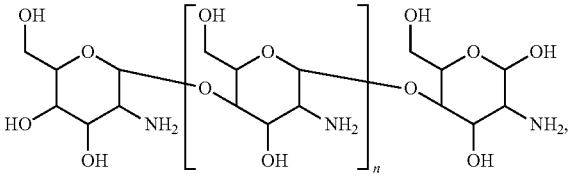

and 10 g of citric acid,

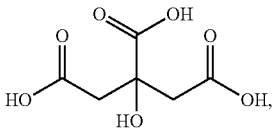

are dissolved in 480 g of $H_2O$. The resulting solution is combined with 2000 g of a solution containing 32% of DMDMH,

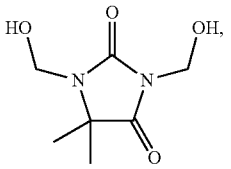

by weight of solution
and 7.5% MDMH,

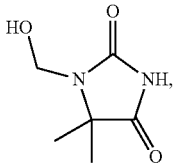

by weight of solution to produce approximately 2500 g of an antimicrobial composition which is:

0.4% citric acid by weight of solution,
0.4% chitosan by weight of solution,
25.6% DMDMH by weight of solution,
5.6% MDMH by weight of solution, and
68% $H_2O$ by weight of solution.

We claim:

1. A method for treating a textile with an antimicrobial composition, the method comprising:

preparing an antimicrobial composition that includes water, an organic acid, chitosan, and one or more heterocyclic N-halamine compounds, wherein the organic acid is present in a concentration of about 0.2% to about 1.0% by weight of solution;

preparing an aqueous solution that comprises the antimicrobial composition;

applying the aqueous solution to a textile; and heating the textile to cure the antimicrobial composition.

2. The method of claim 1, wherein preparing an antimicrobial composition comprises preparing an antimicrobial composition that includes water, citric acid, chitosan, and 1,3-dimethylol-5,5-dimethylhydantoin.

3. The method of claim 1, wherein preparing an antimicrobial composition comprises preparing an antimicrobial composition that includes water, citric acid, chitosan, and 1-methylol-5,5-dimethylhydantoin.

4. The method of claim 1, wherein preparing an antimicrobial composition comprises preparing an antimicrobial composition that includes water, citric acid, chitosan, 1-dimethylmethylol-5,5-dimethylhydantoin, and 1-methylol-5,5-dimethylhydantoin.

5. The method of claim 1, wherein preparing an aqueous solution comprises adding the antimicrobial composition to an aqueous bath solution.

6. The method of claim 5, wherein applying the aqueous solution comprises immersing the textile in the aqueous bath solution.

7. The method of claim 6, further comprising reducing the amount of aqueous bath solution carried by the textile.

8. The method of claim 7, wherein reducing the amount of aqueous bath solution comprises recovering approximately 50 to 95 percent of the absorbed aqueous bath solution from the textile.

9. The method of claim 7, wherein reducing the amount of aqueous bath solution comprises running the textile through squeeze rollers or a centrifugal separator.

10. The method of claim 1, wherein heating the textile comprises heating the textile at approximately 90° C. to 195° C. for at least approximately 15 seconds.

11. The method of claim 1, wherein heating the textile comprises heating the textile at approximately 150° C. to 170° C. for approximately 30 to 60 seconds.

12. The method of claim 1, further comprising adjusting the pH of the aqueous solution to approximately 1.0 to 5.0 prior to applying the solution to the textile.

13. The method of claim 12, wherein adjusting the pH comprises adjusting the pH by adding further organic acid to the aqueous solution.

14. The method of claim 13, wherein adding an organic acid comprises adding citric acid to the aqueous solution.

15. The method of claim 1, further comprising adding an additive to the aqueous solution prior to applying the solution to the textile.

16. The method of claim 15, wherein adding an additive comprises adding an ionic halide salt to the aqueous solution.

17. The method of claim 16, wherein adding an ionic halide salt comprises adding magnesium chloride to the aqueous solution.

18. The method of claim 1, further comprising washing the textile after applying the aqueous solution to the textile to remove excess solution from the textile.

19. The method of claim 18, further comprising drying the textile after washing.

20. The method of claim 1, wherein the textile is a textile that has already been commercially used.

21. The method claim 1, wherein the textile comprises a cellulosic material.

22. The method of claim 21, wherein the textile is at least 15 percent cellulosic material by weight.

23. The method of claim 21, wherein the cellulosic material is cotton.

24. The method of claim 1, wherein preparing an antimicrobial composition comprises preparing an antimicrobial composition with the chitosan present in a concentration of about 0.2% to about 1.0% by weight of solution.

25. The method of claim 1, wherein preparing an antimicrobial composition comprises preparing an antimicrobial composition with the heterocyclic N-halamine compound present in a concentration of about 30% to about 35% by weight of solution.

26. The method of claim 1, wherein preparing an antimicrobial composition comprises preparing an antimicrobial composition with the heterocyclic N-halamine compound present in a concentration of about 20% to about 25% by weight of solution.

27. The method of claim 1, wherein preparing an aqueous solution comprises preparing an aqueous solution with the organic acid present in a concentration of about 0.4% by weight of solution.

28. The method of claim 1, wherein preparing an aqueous solution comprises preparing an aqueous solution with the chitosan present in a concentration of about 0.4% by weight of solution.

29. The method of claim 1, wherein preparing an aqueous solution comprises preparing an aqueous solution with the heterocyclic N-halamine compound present in a concentration of about 33% by weight of solution.

30. The method of claim 1, wherein preparing an aqueous solution comprises preparing an aqueous solution with the heterocyclic N-halamine compound present in a concentration of about 22.6% by weight of solution.

* * * * *